United States Patent [19]

Inagaki et al.

[11] Patent Number: 4,459,817

[45] Date of Patent: Jul. 17, 1984

[54] ROTARY COMPRESSOR

[75] Inventors: Mitsuo Inagaki; Seitoku Ito; Takao Kasagi, all of Okazaki, Japan

[73] Assignee: Nippon Soken, Inc., Nishio, Japan

[21] Appl. No.: 307,937

[22] Filed: Oct. 2, 1981

[30] Foreign Application Priority Data

Dec. 16, 1980 [JP] Japan ..... 55-178359
Jan. 22, 1981 [JP] Japan ..... 56-8167

[51] Int. Cl.[3] ..... F25B 41/00; F04B 49/08

[52] U.S. Cl. ..... 62/196.3; 417/283; 417/299; 417/310; 62/228.5

[58] Field of Search ..... 417/310, 283, 299; 42/228.5, 228.3, 196.3

[56] References Cited

U.S. PATENT DOCUMENTS

| | | | |
|---|---|---|---|
| 2,109,970 | 3/1938 | Grisell | 417/310 |
| 2,266,187 | 12/1941 | Fitzgerald | 62/196.3 |
| 2,286,961 | 6/1942 | Hanson | 62/196.3 |
| 3,224,662 | 12/1965 | Oldsberg | 62/196.3 |
| 3,606,588 | 9/1971 | Romenhaas | 417/299 |
| 3,850,549 | 11/1971 | Hansen et al. | 417/310 |
| 4,060,343 | 11/1977 | Newton | 417/310 X |
| 4,229,147 | 10/1980 | Linden | 417/310 X |

*Primary Examiner*—Richard E. Gluck
*Attorney, Agent, or Firm*—Cushman, Darby & Cushman

[57] ABSTRACT

A rotary compressor formed with an unloading port maintaining a working space in communication with a suction chamber and opened and closed by a valve, to vary the capacity of the compressor. The internal pressure of the working space is sensed in a compression stroke or this pressure and the pressure of a fluid drawn by suction are both sensed, so as to open and close the valve based on the sensed internal pressure of the working space or the pressure differential between the internal pressure of the working space and the pressure of the fluid drawn by suction, to give suitable hysteresis to the operation characteristics of the on-off valve to stabilize the operation of the on-off valve.

2 Claims, 8 Drawing Figures

ROTARY COMPRESSOR

BACKGROUND OF THE INVENTION

This invention relates to rotary compressors, and more particularly it is concerned with a rotary compressor capable of controlling its capacity which has particular utility as a rotary compressor for a cooling system for cooling the space within a compartment of a motor vehicle.

A compressor for a cooling system for a motor vehicle is driven by a crank pulley of the engine through an electromagnetic clutch and generally can be driven in a wide range of number of revolutions of 700–6000 rpm. A compressor is designed such that its capacity is enough to satisfy a cooling load at low-speed rotation, and there has been a tendency that the cooling ability becomes too high at high-speed rotation.

This has raised the problem that when the cooling ability becomes too high, the suction pressure of the compressor drops and the compression ratio increases, with the result that the efficiency of the compressor drops and fuel consumption of the motor vehicle rises. To obviate this problem, it has hitherto been customary to turn on and off the electromagnetic clutch depending on the temperature of the space in the motor vehicle, to thereby bring the compressor to an operating condition which matches the cooling load. However, this suffers the disadvantage that as the electromagnetic clutch is turned on and off repeatedly, during operation of the motor vehicle, acceleration and deceleration result and the operator has the feeling of the steering deteriorating. The aforesaid phenomemon also occurs when the cooling system is actuated for the purpose of removing from the air its moisture content in seasons when the temperature is low.

SUMMARY OF THE INVENTION

This invention has been developed for the purpose of obviating the aforesaid disadvantages of the prior art. Accordingly the invention has as its object the provision of a rotary compressor provided with an unloading mechanism for reducing the capacity of the compressor at high-speed rotation and low-load operation.

The outstanding characteristic of the invention is that an unloading port is formed in the compressor for communicating working space with a suction chamber, and an on-off valve is mounted for controlling the opening and closing of the unloading port, to enable the capacity of the compressor to be smoothly varied. In actuating the on-off valve to open and close the unloading port, the pressure in the working space in the compression stroke or the pressure in the working space in the compression stroke and the pressure of the fluid drawn by suction are sensed and the on-off valve is actuated in accordance with the sensed pressure or the pressure differential between the two sensed pressures, so that the operation of the on-off valve can be stabilized by giving a suitable hysteresis characteristic to the operation of the on-off valve.

DESCRIPTION OF THE PREFERRED EMBODIMENTS

Figure 1:
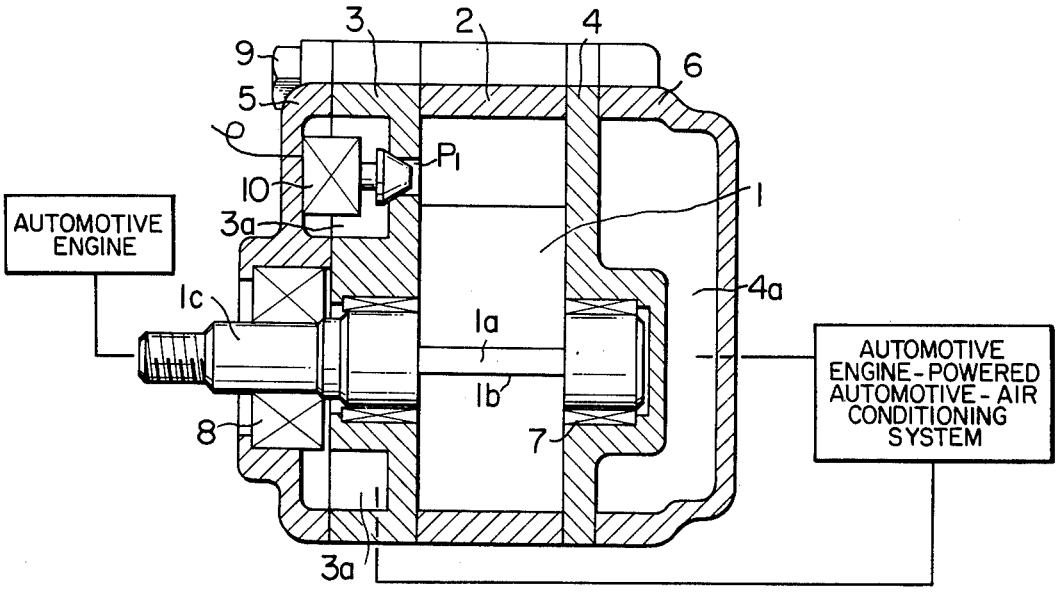
FIG. 1 is a sectional view of the rotary compressor comprising one embodiment of the invention.

Preferred embodiments of the invention will now be described by referring to the accompanying drawings. FIG. 1 shows one embodiment wherein the numeral 1 designates a columnar rotor formed with slits 1*b* in which vanes 1*a* are inserted for sliding movement in a radial direction. The numeral 2 designates a cylindrical liner for regulating the radial reciprocatory movement of the vanes 1*a*. The numerals 3 and 4 designate side plates holding opposite ends of the liner 2 with a small clearance being formed between them and the rotor 1 and vanes 1*a*. The rotor 1, vanes 1*a*, liner 2 and plates 3 and 4 define therebetween a working space V. The liner 2 and side plates 3 and 4 are bolted to a housing 5, 6 as indicated at 9. The rotor 1 is unitarily connected to a rotary shaft 1*c* which is journaled by a bearing 7 at the side plates 3 and 4 for rotation and driven by motive force from the motor vehicle engine through a pulley, electromagnetic clutch, etc., not shown. The numeral 8 designates a shaft sealing device for providing a seal to the shaft with respect to the atmosphere.

Figure 2:
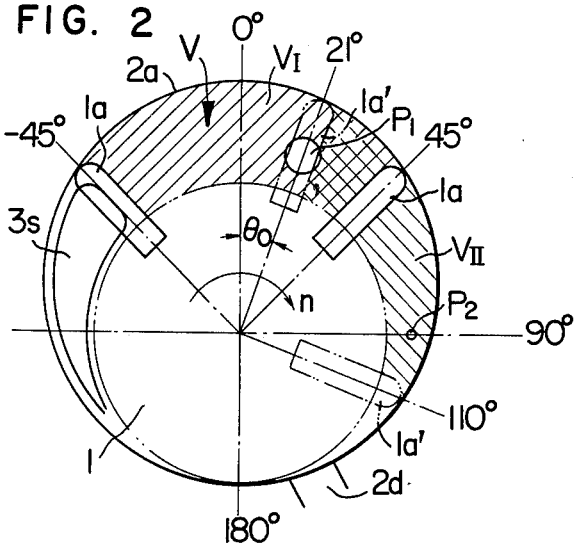
FIG. 2 is a view in explanation of the position in which the unloading port of the rotary compressor shown in FIG. 1 opens.

The side plate 3 and the housing member 5 define a suction chamber 3*a* into which a refrigerant in a gaseous state is drawn by suction from an evaporator of a refrigeration cycle, not shown. The gaseous refrigerant drawn into the suction chamber 3*a* is drawn into the working space V through a suction port 3*s* opening in the side plate 3 as shown in FIG. 2. That is, the working space V is filled with a charge of the refrigerant under the suction pressure until the space V is released from communication with the suction port 3*s*. The charge of the refrigerant drawn into the working space V is compressed as the volume of the space V is reduced and discharged through a discharge port 2*d* to a discharge chamber 4*a*, from which it is delivered to a condenser of the refrigeration cycle.

According to the invention, there is provided an unloading port P1 opening in the side plate 3 and communicating the working space V with the suction chamber 3*a*. Thus when the unloading port P1 is open, compression of the refrigerant is carried out until the working space V is released from communication with the unloading port P1, so that the working space V has a volume $V_{II}$ at the time of initiation of compression with the unloading port P1 being open which is smaller than the volume $V_I$ thereof at the time of initiation of compression with the unloading port P1 being closed. In this embodiment, the unloading port P1 opens in such a position that the volume $V_{II}$ is about 70% of the volume $V_I$.

Figure 3:
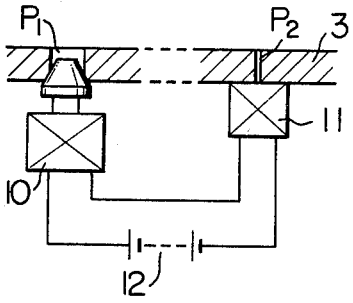
FIG. 3 is a view in explanation of the electric connection of the on-off valve shown in FIG. 1.

The numeral 10 designates an on-off valve for opening and closing the unloading port P1 which comprises an electromagnetic port operative to open the unloading port P1 only when an electric signal is applied thereto. Also, the on-off valve 10 is set such that it opens the unloading port P1 when the pressure in the working space V in compression condition is below a set pressure (6 kg/cm$^2$ abs, for example). More specifically, as shown in FIG. 3, the pressure in the working space V is sensed by a pressure switch 11 via a pressure port P2, and a current is passed from a battery 12 to the on-off valve 10 when the pressure sensed by the switch 11 is below the set value of pressure.

Operation of the rotary compressor according to the invention shown in FIG. 1 will be described. In the description presently to be set forth, changes in the volume of the working space V of the rotary compressor will be expressed by using the center angle of the two vanes 1*a* as a reference ($\theta=0°$) when the volume is maximized $V_I$. The working space V of this embodiment has a shape such that the volume $V_{74}$ is approximate to a value that can be expressed by equation (1), the volume $V_\theta$ being obtained when the rotor 1 and the vanes 1*a* have rotated in a direction n through an angle $\theta$:

$$V_\theta = \left(\frac{1+\cos\theta}{2}\right) V_1 \quad (1)$$

Thus the maximum volume $V_{II}$ of the space V at the time of unloading can be obtained by equation (2):

$$V_{II} = \left(\frac{1+\cos\theta_\theta}{2}\right) V_1 \quad (2)$$

where $\theta_{74}$ is the angle $\theta$ of the opening position of the unloading port P1.

Assuming that the refrigerant used is From 12 (dichlorodiphloromethane) and the polytropic index is 1.14, the pressure $P_\theta$ in the working space V can be expressed by equation (3) from $P_{74}=ps(V_I/V_{74})^{1.14}$:

$$P_\theta = Ps\left(\frac{2}{1+\cos\theta}\right)^{1.14} \quad (3)$$

where Ps is the suction pressure.

From equations (1), (2) and (3), the volume $V_{74}'$ while the compressed space is in the process of compression at the time of unloading can be obtained by equation (1)':

$$V_\theta' = \left(\frac{1+\cos\theta}{2}\right) V_I \quad (1)'$$

The pressure $P_\theta'$ can be expressed from $P_\theta'=Ps(V_{II}/V_\theta')^{1.14}$ by equation (3)':

$$P_\theta' = Ps\left(\frac{1+\cos\theta_\theta}{2}\right)^{1.14}\left(\frac{2}{1+\cos\theta}\right)^{1.14} \quad (3)'$$

Comparison of equations (3) and (3)' gives equation (4):

$$P_\theta'/Ps = Ps\left(\frac{1+\cos\theta_\theta}{2}\right)^{1.14} = Ps(V_{II}/V_I)^{1.14} \quad (4)$$

Thus it will be seen that the pressure $P_\theta'$ in the working space V in the compression stroke at the time of unloading is a pressure representing the power of the adiabatic index of the ratio of the maximum volume $V_{II}$ with loading to the maximum volume $V_I$ without unloading or $V_{II}/V_I$, with respect to the pressure $P_\theta$ at the time of no unloading.

Figure 4:
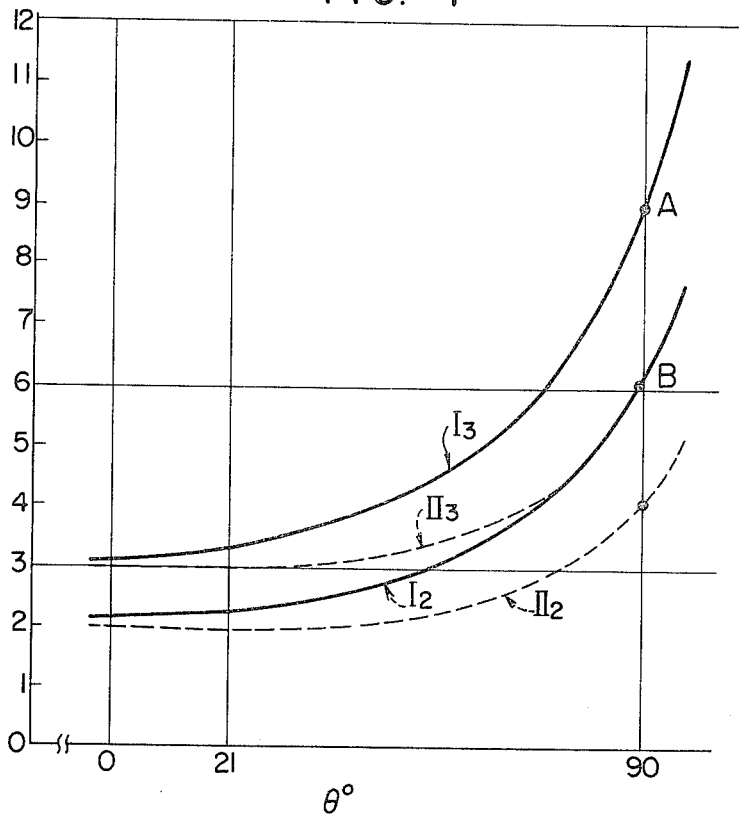
FIG. 4 is a diagrammatic representation of the operation of the rotary compressor shown in FIG. 1.

FIG. 4 is a graph showing the mean pressure P kg/cm$^2$ abs at an arbitrarily selected angle of the rotary compressor of which an embodiment is shown in FIG. 1. In the graph, $I_2$, $I_3$ and $II_2$ and $II_3$ designate operations without unloading and with unloading respectively, and the subscripts 2 and 3 indicate a suction pressure Ps=2 kg/cm$^2$ abs and a suction pressure Ps=3 kg/cm$^2$ abs respectively. In the graph, $\theta=90°$ is the position of the pressure port P2 and $\theta=21°$ is the position of the unloading port P1. In FIG. 4, it will be seen that $I_2$ indicating the suction pressure 2 kg/cm$^2$ abs without unloading and $II_3$ indicating the suction pressure 3 kg/cm$^2$ abs with unloading have substantially the same mean pressure P in the position of the pressure port P2. It will also be seen that at the time of unloading, the mean pressure P in the position of the unloading port P1 shows almost no rise from the suction pressure Ps.

The suction pressure Ps of a cooling system for a motor vehicle has the value of 2.5–4.5 kg/cm$^2$ abs when the cooling load is high, such as when the compressor rotates at low speed or the space to be cooled is high in temperature and humidity. Conversely when the cooling load is low, such as when the compressor rotates at high speed or dehumidification is performed at low temperature, the suction pressure Ps drops below the aforesaid range. These are common knowledge. Thus, in a rotary compressor having an unloading mechanism mounted therein, the pressure of the refrigerant in the pressure port P2 during compression is shown at a point A in FIG. 4 when the cooling load is high (when suction pressure Ps=3 kg/cm$^2$ abs). This pressure is higher than the set pressure 6 kg/cm$^2$ abs set by the pressure switch 11, so that the unloading port P1 remains closed by the on-off valve 10.

However, as the suction pressure Ps drops below 2 kg/cm$^2$ abs with a drop in the temperature of the space cooled by the continuous operation of the cooling system or with a drop in cooling load by high speed operation of the compressor, the pressure of the refrigerant in the pressure port P2 drops below a point B and reaches the pressure 6 kg/cm$^2$ abs set by the pressure switch 11. This actuates the pressure switch 11 which causes a current to be passed from the battery 12 to the on-off valve 10, so as to open the unloading port P1. Thus the volume of the compressor is reduced to 70% that with no unloading. Opening of the unloading port P1 brings the pressure of the refrigerant in the pressure port P2 from point B to a point C, to render the operation of the pressure switch 11 more positive.

An increase in the loading load caused by continued unloading operation or low-speed operation of the compressor causes the suction pressure Ps to rise again. When the suction pressure Ps rises above 3 kg/cm$^2$ abs, the mean pressure in the position of the pressure port P2 becomes higher than that at point B or higher than the set pressure set by the pressure switch 11, so that the pressure switch 11 is turned off. As a result, the unloading port P1 is closed again, to allow the operation to be performed without unloading. At this time, the mean pressure in the position of the pressure port P2 immediately reaches point A, to ensure that the pressure switch 11 is turned off as aforesaid.

Figure 5:
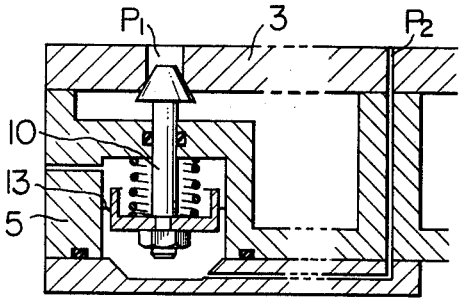
FIG. 5 is a sectional view of the rotary compressor comprising another embodiment.

In the embodiment shown and described hereinabove, the on-off valve 10 is a solenoid type valve to open and close the unloading port P1 by an electric signal supplied from the pressure switch 11. However, the on-off valve 10 may be of a bellowsphragm type as indicated at 13 in FIG. 5 in which the valve is opened and closed by the pressure differential between the atmospheric pressure and the mean pressure in the position of the pressure port P2. In this case, the unloading mechanism of the rotary compressor is further simplified. In the embodiment shown and described hereinabove, the space to be compressed in the rotary compressor has been described as being such that when the working space V has rotated through the angle $\theta$, the volume $V_\theta$ is $$V_\theta = \left(\frac{1+\cos\theta}{2}\right) V1.$$

It is to be understood, however, that the invention is not limited to this specific shape of the working space V and that the invention can have application in rotary compressors of any other shape. Also, the invention is not limited to the volume to be controlled and the set pressure and the operation characteristics of the valve mechanism for effecting unloading as described by referring to the embodiment, and the positions of the unloading port P1 and the pressure port P2 may be varied when necessary.

Figure 6:
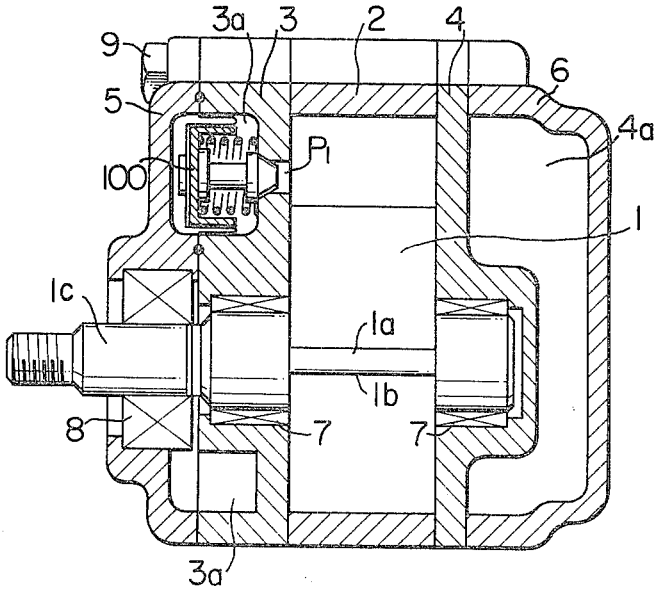
FIG. 6 is a modification of the rotary compressor shown in FIG. 1.

FIG. 6 shows a modification of the embodiment shown in FIG. 1, wherein parts similar to those shown in FIG. 1 are designated by like reference characters. The distinctions between the compressor shown in FIG. 6 and that shown in FIG. 1 will now be described.

Figure 7:
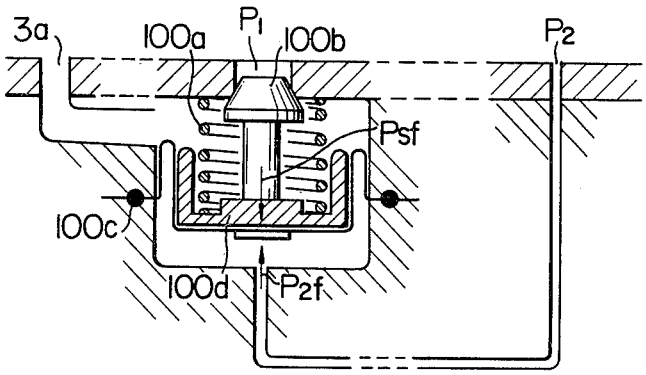
FIG. 7 is a sectional view of the on-off valve shown in FIG. 6.

The numeral 100 designates an on-off valve for opening and closing the unloading port P1 comprising, as shown in FIG. 7, a valve body **100*b* brought into and out of engagement with the port P1, a spring 100*a* urging by a predetermined pressure Psf the valve body 100*b* to move in an opening direction, a valve body support plate 100*d* serving concurrently as a valve seat, and a bellowsphragm 100*c* driving the valve body 100*b* through the valve body support plate 100*d*. The bellowsphragm 100*c* has a surface on the closed valve body 100*b* side which receives a pressure in the working space V in the compression stroke applied thereto through the pressure port P2, and a surface on the open valve body 100*b* side which receives a pressure Ps applied thereto from the suction chamber 3*a*. Thus it is only when the composite of the refrigerant suction pressure Ps and the set pressure Psf of the spring 100*a* is higher than the pressure Psf at the pressure port P2 that the bellow-sphragm 100*c* moves to open the valve body 100*b***, to thereby open the unloading port P1. Stated differently, the unloading port P1 is opened only when the pressure P2*f* of the pressure port P2 and the suction pressure Ps have a pressure differential which is higher than the set pressure Psf of the spring **100*a*** (for example, 3 kg/cm$^2$ abs).

Strictly speaking, the open side pressure of the bellowsphragm **100*c* includes a force from the unloading port P1. However, the port P1 is small in diameter and the pressure is close to the pressure in the suction chamber 3*a***, so that this pressure can be taken no account of.

Figure 8:
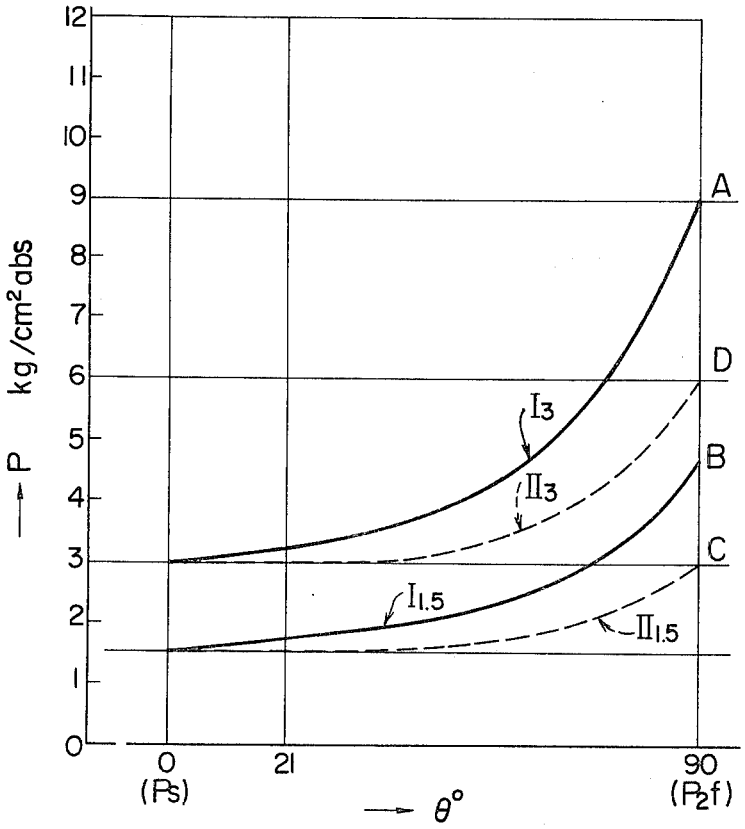
FIG. 8 is a diagrammatic representation of the operation of the rotary compressor shown in FIG. 6.

FIG. 8 shows the mean pressure P kg/cm$^2$ abs at a point of an arbitrarily selected angle $\theta$ of the compressor of the aforesaid embodiment. In the figure, $I_{1.5}$, $I_3$ and $II_{1.5}$, $II_3$ designate operations without unloading and with unloading respectively, and the subscripts 1.5 and 3 indicate a suction pressure Ps=1.5 kg/cm$^2$ abs and a suction pressure Ps=3 kg/cm$^2$ abs respectively. Also, $\theta=90°$ is the position of the pressure port P2 and $\theta=21°$ is the position of the unloading port P1. In the embodiment shown in FIG. 8, the pressure port P2 is formed in a position such that the pressure P2*f* at the pressure port P2 is about twice the suction pressure Ps in operations without unloading, and the unloading port P1 opens in a position such that the pressure P2*f* at the pressure port P2 is about twice the suction pressure Ps in operations with unloading. In FIG. 8, it will be seen that in operations with unloading the mean pressure P in the unloading port P1 shows amost no rise from the suction pressure Ps. That is, it is possible to bring about $P \approx Ps$.

In a rotary compressor having an unloading mechanism incorporated therein, the pressure of the refrigerant at the pressure port P2 in the compression stroke is as indicated at a point A (P2*f*=9 kg/cm$^2$ abs) in FIG. 8 when the cooling load is high (suction pressure Ps=3 kg/cm$^2$ abs) so that the pressure difference (6 kg/cm$^2$ abs) with respect to the suction pressure Ps is higher than the set pressure Ps*f*=3 kg/cm$^2$ abs of the spring **100*a*. Thus the valve mechanism 100** keeps the unloading port P1 closed.

However, thereafter, the cooling load may drop and the suction pressure Ps may drop below 1.5 kg/cm$^2$ abs as the result of a drop in the temperature of the space cooled by continuous operation of the cooling system or by high-speed operation of the compressor. When this is the case, the pressure of the refrigerant at the pressure port P2 becomes as indicated at a point B (P2*f*=4.5 kg/cm$^2$ abs), and the pressure difference P2*f*−ps reaches the set pressure Psf of the spring **100*a* which is Psf=3 kg/cm$^2$ abs. The result of this is that the bellowsphragm 100*c* is actuated and the valve body 100*b* is released, so that the unloading port P1 is opened and the capacity of the compressor is reduced to 70% that of the compressor without unloading. Opening of the unloading port P1 causes the pressure of the refrigerant in the position of the pressure port P2 to shift from point B to a point C, so that the pressure difference with respect to the suction pressure Ps drops and enables the valve body 100*b*** to operate with increased positiveness.

As the cooling load increase as the result of continuous operation with unloading of low-speed operation of the compressor, the suction pressure Ps begins to rise again. When Ps=3 kg/cm$^2$ abs is exceeded by the suction pressure, the mean pressure P2*f* in the position of the pressure port P2 is as indicated at a point D, and the pressure differential P2*f*−Ps is higher than the set pressure Psf of the spring **100*a*. Thus the unloading port P1 is closed again and the condition without unloading prevails. At this time, the mean pressure at the pressure port P2 immediately reaches point A, to thereby ensure that the valve body 100*b*** is closed.

The use of the atmospheric pressure for actuating the bellowsphragm **100*c*** will be discussed in comparison with the use of the suction pressure Ps. When the atmospheric pressure a is used, the balancing of pressures that takes place when an operation without unloading shifts to an operation with unloading can be expressed by equation (5):

$$Psf+a=P2f=3\ Ps \quad (5)$$

The balancing of pressures that takes place when an operation with unloading shifts to an operation without unloading can be expressed by equation (6):

$$Psf+a=P2f'=2\ Ps' \quad (6)$$

Thus the suction pressure Ps that causes unloading condition to cease to exist from existence and causes it to come into existence from nonexistence produces from equations (5) and (6) the difference which is expressed by equation (7):

$$Ps' - Ps = \frac{Psf+a}{2} - \frac{Psf+a}{3} = \frac{Psf+a}{6} \quad (7)$$

However, when the suction pressure Ps is used as a pressure for actuating the bellowsphragm 100*c* as is the case with the present invention, the balancing of pressures that takes place when an operation without unloading shifts to an operation with unloading can be expressed by equation (8):

$$Psf+Ps=P2f+3\ Ps \quad (8)$$

The balancing of pressures that takes place when an operation with unloading to an operation without unloading can be expressed by equation (9):

$$Psf+Ps'=Pef'=2\ Ps' \quad (9)$$

From equations (8) and (9), the suction pressure Ps that causes unloading condition to cease to exist from existence and causes it to come into existence from nonexistence produces the difference which is expressed by equation (10):

$$Ps'-Ps=(Psf)/2 \quad (10)$$

A comparison of equation (10) with equation (7) shows that when $a=1\ kg/cm^2$ abs and $Psf=3\ kg/cm^2$ abs, the difference in suction pressure Ps is greater in the present invention than $5/6\ kg/cm^2$ abs. That is, the rotary compressor according to the invention has higher hysteresis than the prior art with respect to the presence or absence of unloading, thereby enabling operation to be performed with increased reliability.

In the present invention, the unloading port P1 is opened and closed depending on the difference between the pressure P2*f* in the pressure port P2 and the suction pressure Ps. By virtue of this feature, at the startup of the compressor, no pressure differential is produced because the pressure of the refrigerant in the refrigeration cycle balances or even if a pressure differential is produced, the value is very small, so that unloading condition prevails at all times when the compressor is started. This reduces the drive load that is applied to the electromagnetic clutch, thereby eliminating the need to use an electromagnetic clutch of high capacity.

In the embodiment shown and described hereinabove, the bellowsphragm 100*c* is used as on-off valve 100. The invention is not limited to this specific form of on-off valve and a valve mechanism of the solenoid type may be used as on-off valve 100 to electrically sense the pressure P2*f* at the pressure port P2 and the suction pressure Ps and open and close the unloading port P1 by an electric signal.

What is claimed is:

1. A rotary compressor, comprising:

a housing having an outer peripheral liner wall and two opposite end walls defining a generally cylindrical internal space;

a rotor journalled between the opposite end walls of the housing for rotation in said internal space eccentrically of said liner wall;

said rotor having at least two angularly spaced vanes radially movably mounted thereto and in contact with said liner wall so that as the rotor rotates a working space defined between said vanes, liner wall and two opposite end walls is gradually decreased when passing angularly from a filling position towards a discharge position which is non-overlapping with said filling position and thereafter increases when passing angularly from the discharge position into the filling position;

the housing further including means defining a suction chamber constructed and arranged to receive spent gaseous refrigerant in an automotive engine-powered automotive air conditioning system which is subject to varying cooling loads depending in part on whether the ambient air is hot and the automotive engine is turning relatively slowly, either of which are high load conditions, or the ambient air is cool and the automotive engine is turning relatively fast, either of which are low load conditions;

means defining a suction port communicating the suction chamber with said internal space in said filling position of said working space of said rotor;

means defining a discharge port communicating through the housing with said internal space in said discharge position of said working space of said rotor, for discharging gaseous refrigerant which has been compressed in said working space so as to provide working fluid for a refrigeration cycle;

means defining an unloading port for communicating between the suction chamber and the internal space angularly between said filling position and said discharge position of said working space and partially overlapping with said filling position angularly of said internal space, so as to effectively extend said filling position when said unloading port is open;

a valve juxtaposed with said unloading port and being constructed and arranged for opening-up and closing-down said unloading port so as to influence how much of said spent gaseous refrigerant is in said working space when said working space is at last cut off from communication with said suction chamber in each cycle of rotation of said rotor; and pressure sensing means constructed and arranged to be responsive to whether the engine-powered automotive air conditioning system is subject to a high or low load condition, said pressure sensing means being operatively connected to said valve for opening-up the unloading port only when the engine-powered automotive air conditioning system is subject to a low load condition.

2. A vane-type of rotary compressor for drawing a gaseous refrigerant into a working space at an inlet pressure, and for gradually decreasing the volume of the working space in order to then expel the gaseous refrigerant at a delivery pressure which is higher than said inlet pressure, said rotary compressor comprising:

a cylindrical liner having two opposite ends;

two side plates, each being loaded on a respective end of said liner;

a rotor rotatably eccentrically mounted in said liner;

a plurality of vanes, each being slidably arranged in means defining a respective slit formed in said rotor, said liner, said side plates, said rotor and said vanes defining a working space;

means defining a suction chamber;

means defining a suction port in communication with said suction chamber and positioned for communication with said working space during a first segment of rotation of said rotor, and a discharge port positioned for communication with said working space during another, non-overlapping, second segment of rotation of said rotor;

said working space being constructed and arranged to be rotated through a compression zone side in said liner, overlapping said second segment and in which the respective vanes are relatively retracted in the respective slots and the volume of the working space is correspondingly decreased in comparison with its volume in said first segment;

means defining an unloading port formed in one of said side plates for communicating said working space with said suction chamber; and a valve operator to open and close said unloading port for selectively communicating said working space with said suction chamber;

means operatively associated with said valve for sensing the pressure of gaseous refrigerant fluid disposed on the compression zone side in the working space as viewed from the position in which the unloading port opens for actuating said valve to open the unloading port in accordance with the pressure of the fluid;

said valve and said sensing means being constituted by a bellowsphragm valve, said bellowsphragm valve being constructed and arranged to be opened and closed by the pressure differential between atmospheric pressure and the internal pressure of the working space.

* * * * *